United States Patent [19]

Fenton

[11] 4,444,657

[45] Apr. 24, 1984

[54] BREAKOVER DETECTOR FOR CENTRIFUGES

[75] Inventor: Stephen Fenton, Peterborough, Canada

[73] Assignee: Alfa-Laval, Inc., Poughkeepsie, N.Y.

[21] Appl. No.: 498,483

[22] Filed: May 26, 1983

[51] Int. Cl.[3] ..... B04B 11/00

[52] U.S. Cl. ..... 210/95; 210/96.1; 210/104; 210/128

[58] Field of Search ..... 210/781, 787–789, 210/799, 99, 111, 116, 121, 125, 128, 371, 378, 95, 104

[56] References Cited

U.S. PATENT DOCUMENTS

| | | | |
|---|---|---|---|
| 2,402,553 | 6/1946 | Hunt et al. | 210/128 X |
| 3,260,366 | 7/1966 | Duff et al. | 210/99 X |
| 3,679,051 | 6/1972 | Larson et al. | 210/128 X |
| 4,064,893 | 12/1977 | Pitt | 210/96.1 |

*Primary Examiner*—John Adee

*Attorney, Agent, or Firm*—Cyrus S. Hapgood

[57] ABSTRACT

The invention provides a breakover detection device for use with a centrifugal separator. The device comprises a main chamber, a float in the main chamber operative to actuate switch contacts in response to the presence of liquid in the main chamber, an inlet and outlet for the main chamber arranged so that small volumes of liquid trickle from the inlet to the outlet without activating the float and large volumes of liquid at least partially fill the main chamber, thereby activating the float, electrodes in the main chamber for connection to circuitry discriminating between different liquids detected by the float in the main chamber. The device can detect the occurrence of breakover in a centrifugal separator, without leading to shutdown solely as a result of an increase in volume of the separated liquid.

9 Claims, 3 Drawing Figures

Fig. 1.
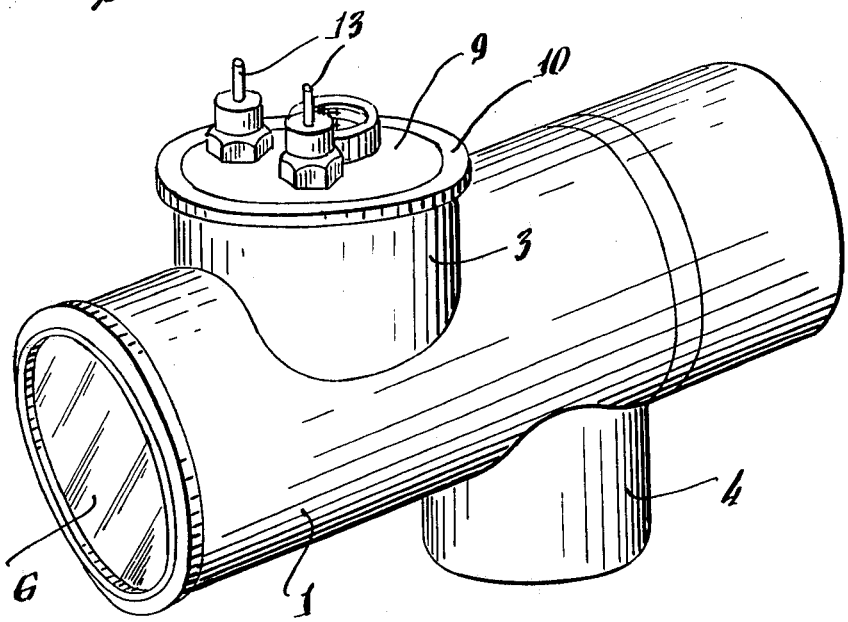
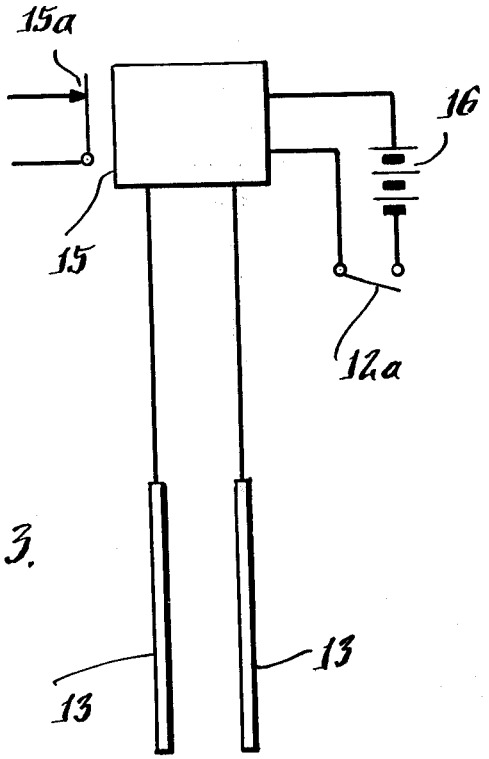
Fig. 3.

9
3
8
12
6
13
h
5
7
2
1
4

BREAKOVER DETECTOR FOR CENTRIFUGES

This invention relates to a breakover detection device for use with a centrifugal separator. The device is operative to shut off the separator when breakover occurs, and is capable of distinguishing between true breakover and a sudden increase in the volume of separated liquid.

Centrifugal separators are commonly used for separating water from oil, for instance in marine fuel supply lines. To bring the separator into operation, the centrifugal bowl has first to be partly filled with water, which acts as a seal within the bowl and prevents oil discharge through the water outlet in operation. Under normal running conditions, the amount of water separated is small, and this serves to maintain the seal within the bowl. The separated water flows from the bowl outlet to a waste line. Occasionally, for various reasons, it happens that the seal in the centrifugal bowl is broken. This causes large quantities of oil to flow through the outlet to the waste line. Not only is this wasteful, it can lead to significant pollution. This phenomenon is referred to as breakover.

In order to detect the presence of breakover, it is common practice to include a control device in the water outlet of the separator. One such device is described in U.S. Pat. No. 2,941,712, issued June 21, 1960. This device is essentially a float which responds to a surge in the volume of liquid in the outlet line. This device works reasonably satisfactorily, but has the disadvantage of being relatively complicated to manufacture. Also, it can happen that there is a surge in the amount of water separated from the oil without a break in the centrifugal seal occurring, and this prior art device does not have the ability to discriminate between genuine breakover and a simple surge in the water discharge.

Accordingly, the present invention provides a breakover detection device for a centrifugal separator, the device comprising a main chamber, a float in said main chamber operative to actuate switch contacts in response to the presence of liquid at least partially filling said main chamber, an inlet and an outlet for said main chamber arranged so that small volumes of liquid trickle from the inlet to the outlet without activating said float, and large volumes of liquid at least partially fill said chamber thereby activating said float, and electrodes in said main chamber for connection to circuitry discriminating between different liquids in the main chamber.

The main chamber is preferably fitted with a sight glass to allow visual inspection of the liquid inside. This is important from the practical view point. In its simplest form of construction, the detection device comprises a horizontal cylinder having the sight glass at one end and the inlet at the other. The outlet comprises a tube extending vertically up through a lower wall portion of the cylinder and terminating at a certain height above the floor of the main chamber. This device has proven simple to manufacture and highly effective in the field.

The invention will now be described in more detail, by way of example only, with reference to the accompanying drawings, in which:

FIG. 1 is a perspective view of a breakover detection device according to one embodiment of the invention;

Figure 2:
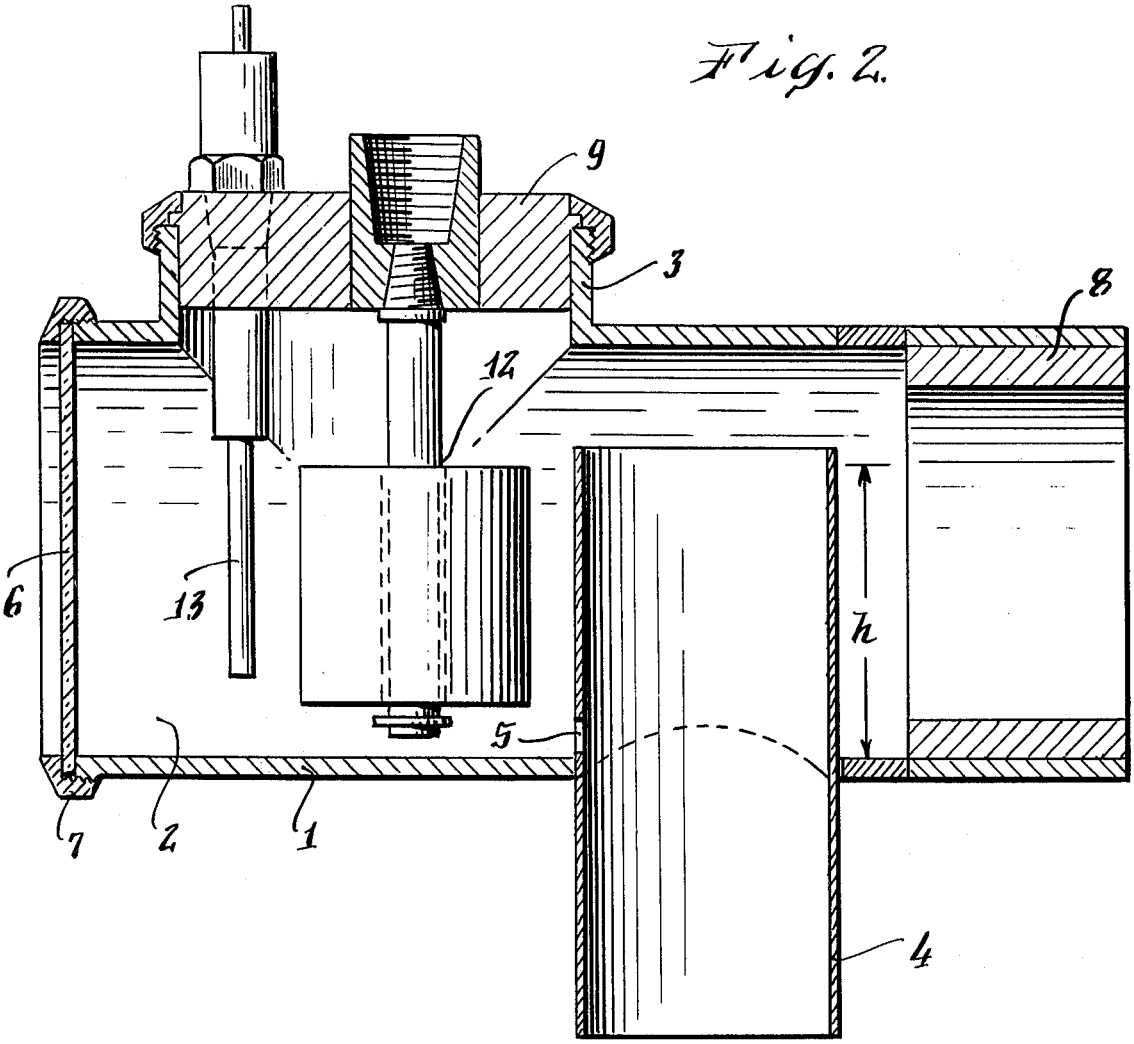
FIG. 2 is a section through the device shown in FIG. 1.

FIG. 3 us a schematic view of a simple arrangement of operating parts of the device.

The breakover detection device comprises a cylindrical body 1 defining a main chamber 2 and having on its upper surface a small branch extension 3. A tube 4 having a diameter less than the diameter of the cylindrical body 1 extends through an aperture in a lower wall portion of the body 1 and is welded thereto. The tube 4 extends upwardly a height h above the floor of the main chamber 2 defined by the cylindrical body 1. At least one drain hole 5 is provided in the tube 4 in the vicinity of the floor of the chamber 2.

The cylindrical body 1 is closed at one end by a plexiglass sight glass 6 which is held on one end of the cylindrical body 1 by means of a collar 7, which may be clamped or screwed onto the cylindrical body 1. The other end of the cylindrical body 1, defining an inlet, is fitted to a coupling 8 for connection to the water discharge line of a centrifugal separator. A cap 9 is fitted onto the branch extension 3 by means of a threaded collar 10. A float switch 12 in the main chamber 2 is fitted to the cap 9. The float switch 12 may be, for example, a commercially available float switch such as a Gems Level Switch, Model LS-1900, Part No. 01907. Also fitted to the cap are two electrodes 13, which extend into the chamber 2.

In operation, the inlet 8 is connected to the water discharge outlet of a centrifugal separator. During normal running, water trickles into the main chamber 1 and out through the drain hole 5 without activating the float 12. With the float inactive, the electrodes 13 are inoperative. Should breakover occur, a surge in liquid flow overwhelms the capacity of the drain hole 5, and the chamber 2 at least partially fills with the liquid. This raises the float of the float switch 12 and causes the contacts thereof to close thereby rendering operative the electrodes 13. These are connected to a circuit sensitive to liquid resistance. For example, a liquid level controller Model LL commercially available from Lisle-Metrix Ltd., will actuate contacts according to the resistivity of the liquid. The controller is set so that it responds to the presence of oil, which of course, has a very low conductivity, not to the presence of water in the chamber 1. When a surge occurs, the main chamber 2 fills up and the float switch 12 activates the controller. If the conductivity is high, indicating that water is in the chamber, the controller takes no action and the separator continues running. If on the other hand the conductivity is low, indicating that oil is in the chamber, the controller opens its contacts and cuts off the separator. It can also take any other suitable action such as activating an alarm or closing the feed valve. Once breakover has occurred, a reset button has to be depressed to allow restarting of the separator.

In addition to being non-responsive to a surge in the water discharge from the separator, the described breakover detection device is much cheaper to manufacture than the device described in the above-referenced U.S. patent. In the prior art device, the float had a tendency to jam, and the chances of this happening in the above-described device are considerably reduced. The device can be made from standard stainless steel pipes, although it may be made in the form of a casting.

The location of the entrance to the upstanding tube 4 at the height h above the floor of the chamber 2 ensures that liquid does not back-up the separator discharge line. When large volumes of liquid are discharged, the liquid quickly fills the chamber 2 to the level of the entrance of the tube 4. At that point, the liquid is rapidly drained off through the entrance of the tube 4 and the chamber fills no further. This is a particularly advantageous feature because, if back-up occurs along the discharge line, it can adversely affect the separator operation.

Referring to FIG. 3, the float-operated switch is shown at 12*a* and the previously identified controller is shown at 15, these parts being in a normally open circuit including a current source 16. The controller's contacts 15*a* are shown in their closed position for operating the centrifugal separator, and they remain closed while float switch 12*a* is open. When the latter closes in response to a surge of water in chamber 2, controller 15 is energized but its contacts 15*a* remain closed due to the high conductivity of the water bridging the electrodes 13 connected to the controller. However, if the liquid bridging the electrodes (after closing of float switch 12*a*) contains a significant amount of oil, its low conductivity causes the controller to open its contacts 15*a* and stop the separator.

I claim:

1. A breakover detection device for a centrifugal separator, said device comprising a hollow body forming a main chamber, a float in said chamber, said body having a liquid inlet and a liquid outlet for said chamber, said inlet and outlet being so arranged that small volumes of liquid trickle from the inlet to the outlet without substantially raising the float and large volumes of liquid at least partly fill the chamber to raise the float to an operating position, normally inactivated means including electrodes in said chamber and operable when activated to discriminate between different liquids in which the electrodes are immersed, and a switch operable to activate said discriminating means in response to raising of the float to said operating position.

2. The detection device of claim 1, in which said hollow body includes a sight glass through which said chamber is visible for inspection.

3. The detection device of claim 1, comprising also a tube forming said outlet of the main chamber, said tube extending upwardly from and terminating at a certain height above the floor of the main chamber.

4. The detection device of claim 3, in which said tube has at least one drain hole near the floor of the chamber to allow small volumes of liquid to trickle therethrough, the tube being open at its upper end to limit the level to which liquid can rise in said chamber.

5. The detection device of claim 4, in which said hollow body is a horizontally disposed cylindrical body including a sight glass located at one end of the body and through which said chamber is visible for inspection, the other end of the cylindrical body forming said inlet.

6. The detection device of claim 5, in which said tube is of smaller diameter than said cylindrical body, said tube extending through a lower wall portion of the cylindrical body.

7. The detection device of claim 2, comprising also means releasably clamping the sight glass to the remainder of the hollow body.

8. The detection device of claim 7, in which said clamping means is a threaded collar.

9. The detection device of claim 5, in which said cylindrical body includes an upwardly directed hollow extension which is open at its upper end, said body including also a cap closing the upper end of said extension and on which said float and electrodes are mounted.

* * * * *